US005437511A

United States Patent [19]

Halket et al.

[11] Patent Number: 5,437,511

[45] Date of Patent: Aug. 1, 1995

[54] TAPE PRINTING APPARATUS

[75] Inventors: Andrew R. Halket, Cambridge; Richard W. Ware, Welwyn Garden City; Charles R. Sims, Royston, all of United Kingdom

[73] Assignee: Esselte Dymo N.V., St. Niklaas, Belgium

[21] Appl. No.: 180,210

[22] Filed: Jan. 11, 1994

[30] Foreign Application Priority Data

Jan. 13, 1993 [GB] United Kingdom ..... 9300586

[51] Int. Cl.[6] ..... B41J 29/38

[52] U.S. Cl. ..... 400/54; 400/208; 400/668

[58] Field of Search ..... 400/120, 207, 208, 612, 400/613, 668, 663, 664, 690.4, 54; 346/108; 101/288

[56] References Cited

U.S. PATENT DOCUMENTS

| | | | |
|---|---|---|---|
| 4,676,679 | 6/1987 | Kondo | 400/54 |
| 4,798,485 | 1/1989 | Onoda et al. | 400/668 |
| 4,943,815 | 7/1990 | Aldrich et al. | 346/108 |
| 5,028,934 | 7/1991 | Kasai et al. | 400/120 |
| 5,193,919 | 3/1993 | Godo et al. | 400/690.4 |
| 5,295,753 | 3/1994 | Godo et al. | 400/613 |

FOREIGN PATENT DOCUMENTS

| | | | |
|---|---|---|---|
| 0181949 | 5/1986 | European Pat. Off. . | |
| 0487313A1 | 5/1992 | European Pat. Off. . | |
| 181671 | 8/1986 | Japan | 400/668 |
| 189971 | 8/1986 | Japan | 400/54 |
| 2229676 | 10/1990 | United Kingdom . | |

OTHER PUBLICATIONS

Patent Abstracts of Japan, vol. 11, No. 74 (M-568) 6 Mar. 1987 & JP-A-61 229 585 (Hitachi Ltd.) 13 Oct. 1986.

Patent Abstracts of Japan, vol. 15, No. 378 (M-1611) 24 Sep. 1991 & JP-A-03 151 261 (Seiko Epson Corp) 27 Jun. 1991.

Patent Abstracts of Japan, vol. 7, No. 137 (M-222) 15 Jun. 1983 & JP-A-58 051 173 (Nippon Denki KK) 25 Mar. 1983.

Patent Abstracts of Japan, vol. 12, No. 109 (M-682) 8 Apr. 1988 & JP-A-62 238 779 (Matsushita Electric Ind Co) 19 Oct. 1987.

*Primary Examiner*—Ren Yan

*Attorney, Agent, or Firm*—Pennie & Edmonds

[57] ABSTRACT

There is described a printing apparatus, particularly a label printer, which includes a switching mechanism operable in response to movement of the lid to permit operation of the printing apparatus only when the lid is closed. This can be combined with detection of the presence or absence of a cassette in a cassette receiving bay of the apparatus so that operation of the printing apparatus is permitted only in the presence of a cassette and with the lid in the closed position.

10 Claims, 4 Drawing Sheets

TAPE PRINTING APPARATUS

FIELD OF THE INVENTION

The invention relates generally to tape printing apparatus and in particular to apparatus which is capable of receiving a cassette containing a printing tape.

BACKGROUND OF THE INVENTION

Printing apparatus of the type with which the present invention is concerned include thermal printers of the type disclosed in EP-A-322918 and EP-A-322919 (Brother Kogyo Kabushiki Kaisha) and EP-A-0267890 (Varitronics). These printers each include a printing device having a cassette receiving bay for receiving a cassette or tape holding case. In EP-A-0267890, the tape holding case houses an ink ribbon and a substrate tape, the latter comprising an upper image receiving layer secured to a backing layer by adhesive. In EP-A-322918 and EP-A-322919, the tape holding case houses an ink ribbon, a transparent image receiving tape and a double-sided adhesive tape which is secured at one of its adhesive-coated sides to the image tape after printing and which has a backing layer peelable from its other adhesive-coated side. With both these apparatus, the image transfer medium (ink ribbon) and image receiving tape (substrate) are in the same cassette.

The present applicants have developed a different type of printing apparatus which is described for example in copending British Application No. 9212423.9, the contents of which are herein incorporated by reference.

In this printing apparatus, the substrate tape is similar to that described in EP-A-0267890 but is housed in its own tape holding case while the ink ribbon is similarly housed in its own tape holding case.

In all of these cases, the image receiving tape passes in overlap with the ink ribbon through a print zone consisting of a print head and a platen against which the print head can be pressed to cause an image to transfer from the ink ribbon to the image receiving tape. There are many ways of doing this, including dry lettering or dry film impression, but the most usual way at present is by thermal printing where the print head is heated and the heat causes ink from the ink ribbon to be transferred to the image receiving tape. With the printing apparatus described in GB 9212423.9, the tape holding case with the ink ribbon is placed on one side of the print zone while the tape holding case with the substrate is placed on the other side of the print zone. In these printing apparatus, the tape holding case is commonly referred to as a cassette.

The printing apparatus of GB 9212423.9 and of EP 322919 have a lid or cover member which covers a cassette receiving bay arranged to receive the cassette. It is one object of the present invention to inhibit operation of the printer unless the lid or cover member is in its correct position.

If an attempt is made to operate the thermal printing apparatus without a cassette inserted therein, a situation can arise where the print head contacts the platen directly, without the interposition of tape and/or ink ribbon. In this case, heat at the thermal print head could cause melting or damage to the platen and leave deposits on the print head. It is also thus desirable to determine when a tape holding case is in place and to allow operation of the printing apparatus only in these circumstances. Where only one cassette is required, detection of the presence of this cassette is desirable. Where two cassettes are required, it is desirable to ascertain that at least one cassette is present.

SUMMARY OF THE INVENTION

According to the present invention there is provided a printing apparatus having a cassette receiving bay for receiving a cassette having printing tape; a cover member movable between an open position in which a cassette can be inserted into the cassette receiving bay and a closed position in which the cover member covers the cassette receiving bay; and a switching mechanism operable in response to movement of the cover member to permit operation of the printing apparatus only when the cover member is in the closed position.

Where the printing apparatus has a keyboard for entering data to be printed, the cassette receiving bay can be adjacent the keyboard with the cover member comprising a lid hinged to a main body of the printer to open upwardly.

In the preferred embodiment, the switching mechanism is also operable in response to the presence or absence of a cassette in the cassette receiving bay so that operation of the printing apparatus is permitted only in the presence of a cassette and with the lid in the closed position.

The present invention relates in the preferred embodiment particularly to detection of the presence or absence of the ink ribbon cassette. However, the invention is not restricted to detection of the ink ribbon cassette but could be used for the detection of cassettes housing substrate tape or a plurality of tapes.

The invention also provides in combination: a printing apparatus having a cassette receiving bay for receiving a cassette housing printing tape, a cover member movable between an open position in which a cassette can be inserted into the cassette receiving bay and a closed position in which the cover member covers the cassette receiving bay, and a switching mechanism; and a cassette inserted in, or for insertion in, the cassette receiving bay and having means operable to actuate said switching mechanism to permit operation of the printing apparatus only when a cassette is inserted and with the cover member in the closed position, printing operations otherwise being inhibited.

The invention can be used in any type of printing apparatus where a cassette is needed for use in printing. As described herein the invention is applied to the presence or absence of a cassette containing ink ribbon but the principle is applicable to other types of cassettes. The invention is particularly applicable where two cassettes are required and where detection means is provided for both cassettes. Suitable detection means for the image receiving tape cassette are described in our copending Application No. 9212004.7 the contents of which are herein incorporated by reference. If the detection means for the substrate cassette should fail, it is particularly advantageous to ensure that the printing apparatus cannot operate unless the ink ribbon cassette at least is present.

The printing apparatus will generally comprise printing means in the form of a print head and platen at a print zone.

Preferably the movement of the lid automatically causes the print head to come into contact with the platen so that the "lid closed" position is synonymous with a "print ready" state at the print zone. One way of achieving this is described for example in the Applicant's European Application Publication No. 0487313, the contents of which are herein incorporated by reference.

In the preferred embodiment, the invention has the advantage that printing is inhibited in both the conditions that the lid is open and that there is no cassette present. Thus an incautious user cannot operate the printing apparatus in a way which could cause damage to it.

Preferably the switching mechanism comprises a switch with first and second switching terminals and first and second switch actuating means associated respectively with the first and second switching terminals, the first switch actuating means being associated with the cover member and the second switch actuating means being associated with the cassette.

The first switch actuating means can comprise a switching member movable with the cover member to cause it to bring the first terminal into contact with the second terminal when the cover member is open.

The second switch actuating means can comprise a switching member biased in a direction such that the first and second terminals are in contact, regardless of the position of the first switch actuating means, the switching member being movable in response to the actuating means in the cassette to cause the second terminal to come out of contact with the first terminal. The arrangement is such that the second switching member is then only brought out of contact with the first switching member when the cassette is inserted and the cover member is closed.

The switching member of the second switch actuating means can comprise a switching block pivotably mounted with respect to a base of the cassette receiving bay and having a part protruding above the base, the cassette having a slot which engages the protruding part and thus causes the switching block to pivot against its biased direction.

For a better understanding of the present invention and to show how the same may be carried into effect, reference will now be made by way of example to the accompanying drawings.

BRIEF DESCRIPTION OF THE DRAWINGS

FIG. 2—lid open, no cassette

FIG. 3—lid closed, no cassette

FIG. 4—lid open, cassette in

FIG. 5—lid closed, cassette in;

FIGS. *7a* to *7e* are different elevations of the switching block; and

Figure 8:
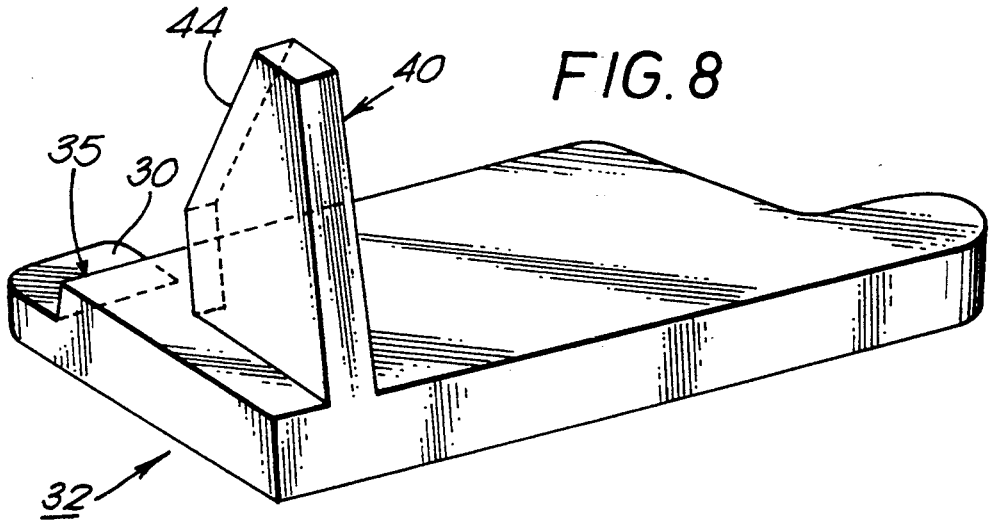

FIG. 8 is a perspective view of the switching block.

DESCRIPTION OF THE PREFERRED EMBODIMENT

Figure 1:
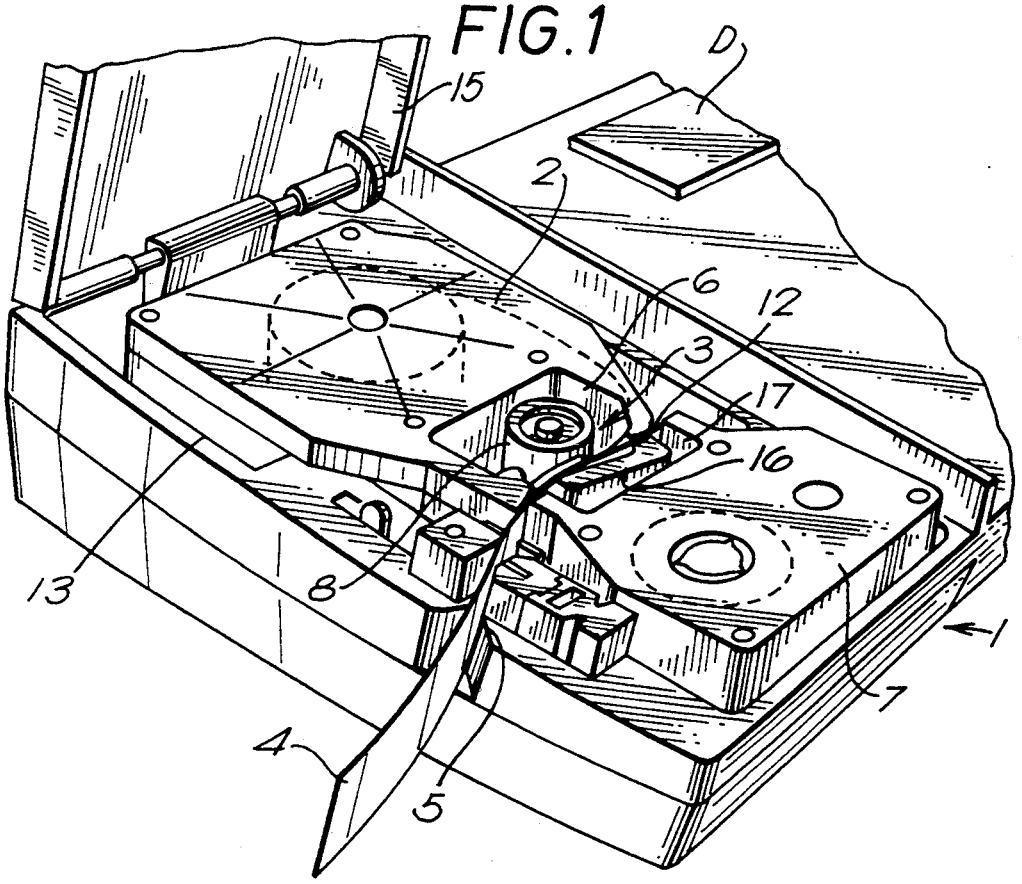
FIG. 1 is a perspective view showing two cassettes inserted into a printing device.

FIG. 1 shows in plan view part of the main body 1 of a printing device with two cassettes arranged in a cassette receiving bay 13. The upper cassette 2 contains a supply of image receiving tape 4 which passes through a print zone 3 of the printer to an outlet 5 of the printer. The image receiving tape 4 comprises an upper layer for receiving a printed image on one of its surfaces and having its other surface coated with an adhesive layer to which is secured a releaseable backing layer. The upper cassette 2 has a recess 6 for accommodating a platen 8 of the printer. The platen is mounted for rotation on a pin. As an alternative, the platen could be mounted for rotation within a cage moulding.

The lower cassette 7 contains an ink ribbon 12 which extends from a supply spool to a take-up spool within the lower cassette 7. The ink ribbon 12 extends through the print zone 3 in overlap with the image receiving tape 4. The lower cassette 7 has a recess 17 for receiving a print head 16 of the printer. The print head is movable between an operative position in which it is in contact with the platen 8 and holds the thermal transfer ribbon 12 and the image receiving tape 4 in overlap between the print head 16 and the platen 8 and an inoperative position (shown in FIG. 1) in which it is held away from the platen 8 to release the thermal transfer ribbon 12 and image receiving tape 4.

The main body 1 carries a keyboard (not shown), display (shown partially at D) and other usual features of the printing apparatus. The cassette receiving bay 13 has a lid 15 which is hingedly mounted to the main body and which can be pivoted between an open position (shown in FIG. 1) and a closed position. The print head 16 is connected to the lid through a mechanical linkage (24 in FIG. 2) so that when the lid is opened the print head is automatically brought into its inoperative position and when the lid is closed it is brought into its operative position. This can be accomplished as described in Application EP-A-0487313.

Figure 2:
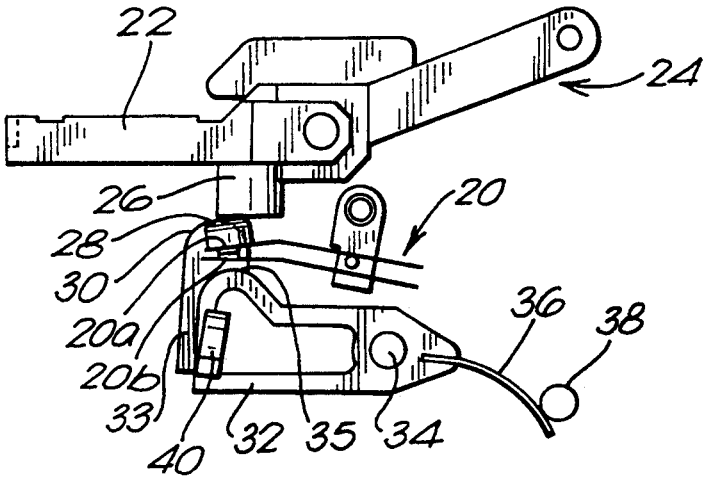
FIGS. 2 to 5 show in plan the switching mechanism of the printing device in each of its four states as follows.

FIG. 2 shows a switching mechanism for detecting whether or not the lid is closed and whether or not the lower cassette 7 is in place. The switching mechanism comprises a microswitch 20 which is mounted under the floor of the cassette receiving bay for the lower cassette. The microswitch 20 has upper and lower terminals 20*a*, 20*b* mounted on respective leaf springs and which when in contact prohibit operation of the printing apparatus. The print head 16 (not shown in FIG. 2) is supported on a print head arm 22 which moves with the mechanical linkage 24 coupled to the lid. The print head arm 22 carries a print head arm switching member 26 which, with the lid open and the print head in the inoperative position, bears on a contact 28 which depresses the upper terminal 20*a* into contact with the lower terminal 20*b*.

The switching mechanism also comprises a switching block 32 which is pivotably mounted on a pin 34 and which is also located under the floor of the cassette receiving bay. The switching block 32 is biased upwardly in the Figures (rearwardly in an actual printing apparatus) by means of a spring 36 acting against a pin 38.

Figure 6:
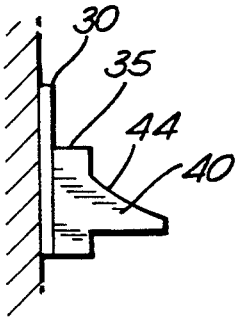
FIG. 6 is a side view of the switching block.

The switching block 32 carries a switching piece 33 which defines, still under the floor of the cassette receiving bay, an abutment surface 30 which lies under the leaf springs and which serves to prevent the print head arm switching member 26 from pushing the terminal 20*a* too far downwards. The switching piece 33 also has, extending through the floor of the cassette receiving bay, an angled block 40. As can be seen most clearly in FIG. 6, the angled block has a sloping surface 44 which slopes downwardly (forwardly in an actual printing apparatus). The switching block 32 also has a switching surface 35 located under the floor of the cassette receiving bay, to cooperate with the lower switching terminal 20*b*. FIGS. *7a* to *7e* show different elevations of the switching block to show its construction more clearly. In particular, the abutment surface 30 which serves to prevent the switching member from pushing the terminal 20*a* too far documents, the switching surface 35 which serves to cooperate with the lower switching terminal 20*b* and the angle block 40 which serves to be received by a slot 50 of the lower cassette 7.

Figure 3:
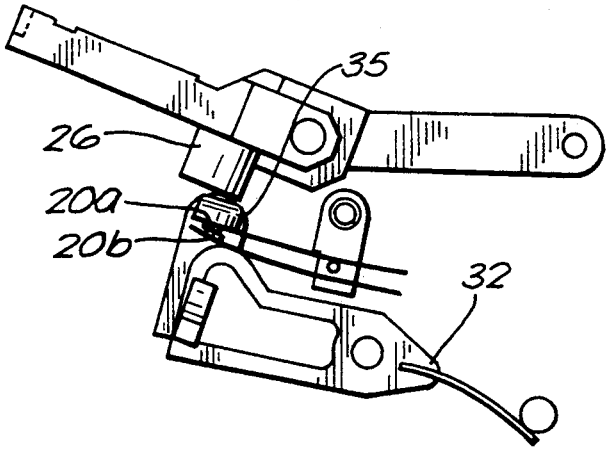

As can be seen in FIG. 2, with the lid open, the action of the print head arm switching member 26 on the contact 28 causes the terminal 20*a* to be in contact with the terminal 20*b*. The action of the switching member 26 on the abutment surface 30 pushes the switching block downwardly in the Figure against the action of the spring 36. As shown in FIG. 3, with the lid closed and no lower cassette present, the switching block 32 is biased rearwardly in the printing apparatus (that is, towards the rear of the cassette receiving bay) to bring the switching surface 35 into contact with the leaf spring carrying the contact terminal 20*b* so that this is pushed up into contact with the terminal 20*a*. In this case, the abutment surface 30 eventually abuts the switching member 26 and so prevents the switching block from forcing the leaf springs too far in the rearward direction.

Figure 4:
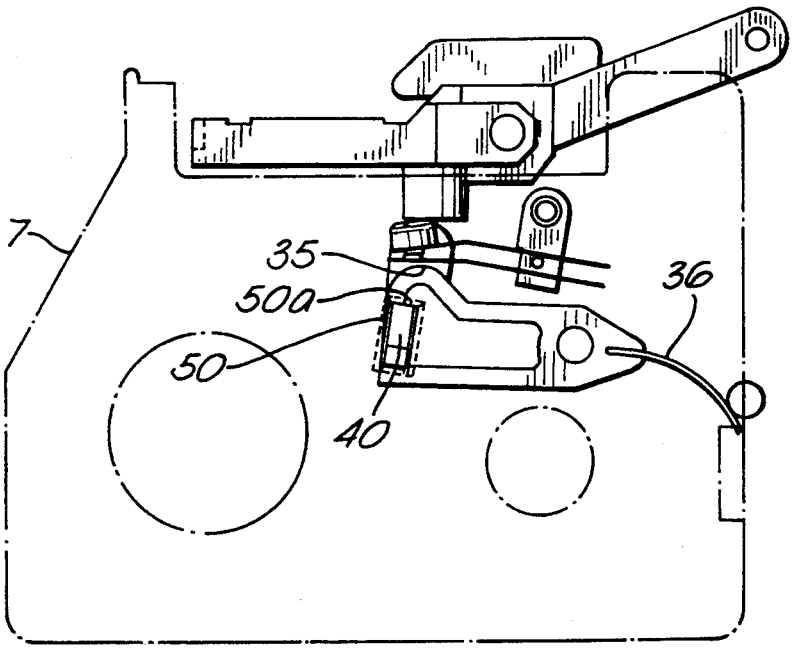
Figure 5:
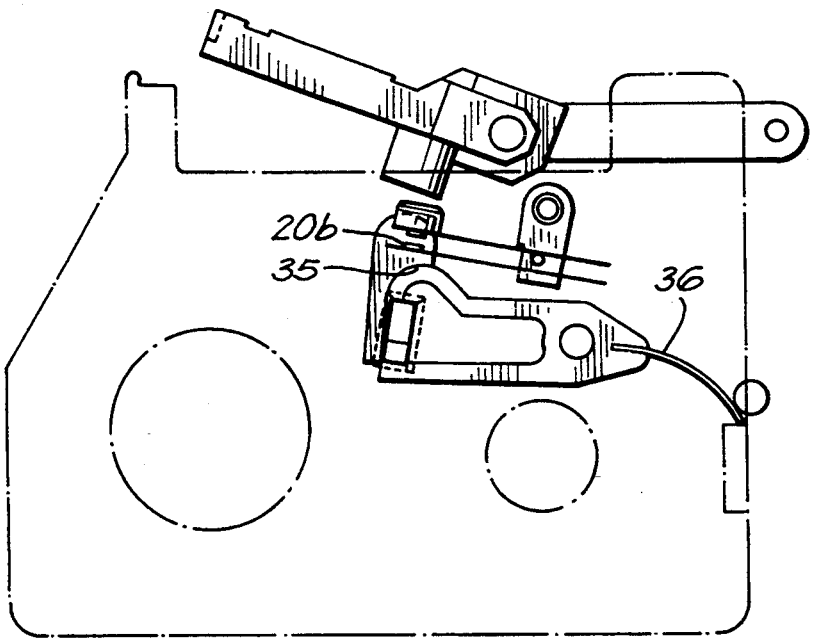
Figure 7A:
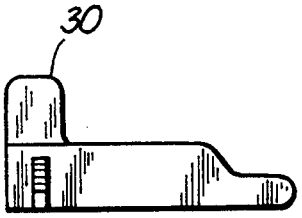
Figure 7B:
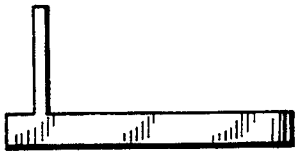
Figure 7C:
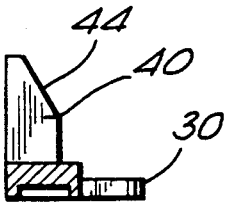
Figure 7D:
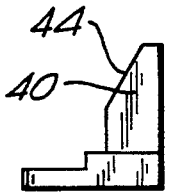
Figure 7E:
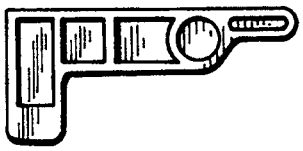

Referring now to FIGS. 4 and 5, the lower cassette 7 for use with this switching mechanism has a slot 50 sized to receive the angled block 40. As a cassette is inserted, the rearward edge 50*a* of the slot slides over the sloping surface 44 and causes the angled block and thus the switching block 32 to be pulled forward against the action of the spring 36. In this position as can be seen in FIG. 5, the switching surface 35 no longer contacts the leaf spring carrying the lower terminal 20*b*. Thus, when the cassette is in place, actuation of the switch depends on the state of the lid. When the lid is open, as shown in FIG. 4, the switch is closed as described with reference to FIG. 2. With the switch closed, an inhibit signal is passed to a controller so that operation of the printing apparatus is inhibited. When the lid is closed, as shown in FIG. 5, the switch is open since there is now no pressure on the contact 28 nor on the leaf spring carrying the lower terminal 20*b*. With the switch in the open position, a permit signal is passed to a controller of the printing apparatus indicating that the apparatus is ready to function properly.

What is claimed is:

1. A tape printing apparatus comprising:

a cassette receiving bay having a base and being arranged to receive a cassette of printing tape therein;

a cover member for covering the cassette receiving bay; and a switching mechanism operable between first and second positions, being located below the base of the cassette receiving bay, and including:

first and second switching terminals which are in contact in the first position and which are spaced apart in the second position;

first switch actuating means actuated by the cover member and associated with said first switching terminal, whereby the position of the cover member influences the position of the first switching terminal; and pivotally mounted second switch actuating means associated with said second switching terminal and having a protrusion which extends above the base of the cassette receiving bay, said protrusion arranged to engage in a slot of a cassette, and when inserted, thereby cause pivotal movement of said second switch actuation means to influence the position of the second switching terminal, whereby one of the first and second positions of the switching terminals is only attained when said cover member covers the cassette receiving bay and a cassette is in the cassette receiving bay, said printing apparatus only operating when said switching terminals are in said one of the first and second positions.

2. A printing apparatus according to claim 1 further comprising a main body and a keyboard for entering data to be printed, wherein the cassette receiving bay is adjacent the keyboard, and the cover member comprises a lid hinged to said main body of the printing apparatus to open upwardly.

3. A printing apparatus according to claim 1 or 2, which further comprises printing means including a print head and platen at a print zone of the printing apparatus.

4. A printing apparatus according to claim 3, further comprising means for causing the print head to come into contact with the platen automatically on movement of the cover member so that when the cover member covers the cassette receiving bay the print zone is in a "print ready" state.

5. A printing apparatus according to claim 1, wherein the first switch actuating means comprises a first switching member movable with the cover member to cause the first and second terminals to be in said first position when the cassette receiving bay is uncovered.

6. A printing apparatus according to claim 5, wherein the second switch actuating means comprises a second switching member biased in a direction such that the first and second terminals are in said first position when the cassette receiving bay is empty, regardless of the position of the first switch actuating means, the second switching member being movable in response to insertion of a cassette to cause the second switch actuating means to pivot against said biased direction, whereby the switching terminals are in said second position when said cover member covers the cassette receiving bay.

7. In combination:

a tape printing apparatus comprising a cassette receiving bay having a base and being arranged to receive a cassette of printing tape therein;

a cover member for covering the cassette receiving bay; and a switching mechanism operable between first and second positions, being located below the base of the cassette receiving bay, and including:

first and second switching terminals which are in contact in the first position and which are spaced apart in the second position;

first switch actuating means actuated by the cover member and associated with said first switching terminal, whereby the position of the cover member influences the position of the first switching terminal; and pivotally mounted second switch actuating means associated with said second switching terminal and having a protrusion which extends above the base of the cassette receiving bay, said protrusion arranged to engage in a slot of a cassette, and when inserted, thereby cause pivotal movement of said second switch actuation means to influence the position of the second switching terminal; and a cassette received in said cassette receiving bay and having a slot which actuates said second switch actuation means, whereby one of the first and second positions of the switching terminals is only attained when said cover member covers the cassette receiving bay, and said tape printing apparatus only operates when said switching terminals are in said one of the first and second positions.

8. The combination according to claim 7, wherein the cassette is an ink ribbon cassette.

9. A tape printing apparatus comprising, a cassette receiving bay for receiving a cassette of tape and comprising an opening to permit the insertion and removal of a cassette and a base;

a cover member for closing said cassette receiving bay opening;

a switching mechanism for permitting operation of the printing apparatus only when a cassette is in said cassette receiving bay and the cassette receiving bay opening is closed by said cover member, said switching mechanism operable between first and second positions, being located below the base of the cassette receiving bay, and including:

first and second switching terminals which are in contact in the first position and which are spaced apart in the second position, said printing apparatus only operating when said terminals are in said second position, first switching actuating means associated with said first switching terminal and with said cover member;

pivotally mounted second switch actuating means associated with the second switching terminal and having a protrusion extending above the base of the cassette receiving bay, said protrusion arranged to engage in a slot of a cassette, and when inserted, thereby cause pivotal movement of said second switch actuating means to influence the position of the second switching terminal, whereby said first and second switch actuating means cause the first and second switching terminals to be in said second position when a cassette is in said cassette receiving bay and said cassette receiving bay opening is closed by said cover member.

10. A cassette of printing tape in combination with a tape printing apparatus comprising:

a cassette receiving bay having a base and being arranged to receive said cassette of printing tape therein;

a cover member for covering the cassette receiving bay; and a switching mechanism operable between first and second positions, being located below the base of the cassette receiving bay, and including:

first and second switching terminals which are in contact in the first position and which are spaced apart in the second position;

first switch actuating means actuated by the cover member and associated with said first switching terminal whereby the position of the cover member influences the position of the first switching terminal; and pivotally mounted second switch actuating means associated with said second switching terminal and having a protrusion which extends above the base of the cassette receiving bay, said protrusion arranged to engage in a slot of a cassette, and when inserted, thereby cause pivotal movement of said second switch actuation means to influence the position of the second switching terminal, whereby one of the first and second positions of the switching terminals is only attained when said cover member covers the cassette receiving bay and a cassette is in the cassette receiving bay, said printing apparatus only operating when said switching terminals are in said one of the first and second positions, wherein said cassette has first and second opposed surfaces, the first surface contacting the base of the cassette receiving bay when inserted therein, said first surface of the cassette having a slot which, when the cassette is inserted in the cassette receiving bay, engages the protrusion of the second switch actuating means of the tape printing apparatus to cause pivotal movement of said second switch actuating means.

* * * * *